US006726502B1

(12) United States Patent
Hayes

(10) Patent No.: US 6,726,502 B1
(45) Date of Patent: Apr. 27, 2004

(54) LED AND FLEX CABLE LIGHTING ASSEMBLY

(75) Inventor: Earl J. Hayes, South Lyon, MI (US)

(73) Assignee: FCI Americas Technology Inc., Reno, NV (US)

( * ) Notice: Subject to any disclaimer, the term of this patent is extended or adjusted under 35 U.S.C. 154(b) by 0 days.

(21) Appl. No.: 10/394,316

(22) Filed: Mar. 21, 2003

(51) Int. Cl.[7] ..... H01R 4/24
(52) U.S. Cl. ..... 439/422
(58) Field of Search ..... 439/422, 421, 439/423, 424, 425, 426, 442, 444; 362/249, 252, 300, 227, 235, 237

(56) References Cited

U.S. PATENT DOCUMENTS

| | | | | | |
|---|---|---|---|---|---|
| 3,197,729 | A | * | 7/1965 | Sarazen | 439/422 |
| 4,173,035 | A | * | 10/1979 | Hoyt | 362/249 |
| 4,204,273 | A | * | 5/1980 | Goldberg | 362/219 |
| 4,514,791 | A | * | 4/1985 | Tokieda | 362/249 |
| 4,749,368 | A | * | 6/1988 | Mouissie | 439/421 |
| 4,921,440 | A | | 5/1990 | Matsumoto | 439/421 |
| 4,984,999 | A | * | 1/1991 | Leake | 439/425 |
| 5,107,584 | A | | 4/1992 | Takeda | 29/622 |
| 5,137,468 | A | | 8/1992 | Murakami | 439/422 |
| 5,139,433 | A | * | 8/1992 | Bohaty | 439/395 |
| 5,321,593 | A | * | 6/1994 | Moates | 362/251 |
| 5,643,007 | A | | 7/1997 | Younger | 439/421 |
| 5,860,831 | A | | 1/1999 | Roder et al. | 439/422 |
| 6,319,056 | B1 | | 11/2001 | Schunk et al. | 439/505 |
| 6,345,902 | B2 | * | 2/2002 | Ohkohdo et al. | 362/226 |
| 6,394,626 | B1 | | 5/2002 | McColloch | 362/251 |
| 6,439,921 | B1 | | 8/2002 | Hio | 439/422 |

* cited by examiner

*Primary Examiner*—Ross Gushi
(74) *Attorney, Agent, or Firm*—Harrington & Smith, LLP

(57) ABSTRACT

A lighting assembly including a flex cable; and a plurality of lighting devices directly connected to conductors of the flex cable. The lighting devices each comprise leads placed against an exterior side of the flex cable and have teeth which pierce through insulation of the flex cable and the conductors to make a mechanical and electrical connection with the flex cable.

20 Claims, 3 Drawing Sheets

LED AND FLEX CABLE LIGHTING ASSEMBLY

BACKGROUND OF THE INVENTION

1. Field of the Invention

The present invention relates to a lighting assembly and, more particularly, to a lighting assembly comprising a flex cable and LEDs.

2. Brief Description of Prior Developments

Flex cables, such as flexible flat conductor cable (FFC) or flexible printed circuit cable (FPC) are generally well known in the art. U.S. Pat. No. 4,749,368 discloses a contact strip terminal which can be attached to a flex cable.

There is a need, such as in automobile applications, for a lighting assembly which uses a flex cable. The use of a flex cable can allow the lighting assembly to be located in relatively small thickness areas. However, the attachment of a lighting device to a flex cable would normally require a connector interface. Such a connector interface increases the cost of the lighting assembly, increases the size of the lighting assembly, and causes potential reliability problems. Thus, there is a desire to provide a lighting assembly which uses a flex cable, but which would not include the problems which would otherwise be created with a connector interface between the flex cable and the lighting device.

SUMMARY OF THE INVENTION

In accordance with one aspect of the present invention, a lighting assembly is provided which includes a flex cable; and a plurality of lighting devices directly connected to conductors of the flex cable. The lighting devices each comprise leads placed against an exterior side of the flex cable and have teeth which pierce through insulation of the flex cable and the conductors to make a mechanical and electrical connection with the flex cable.

In accordance with another aspect of the present invention, a lighting assembly is provided comprising a flex cable; a plurality of light emitting diodes (LEDs) connected to conductors of the flex cable; and splice terminals connecting predetermined ones of the conductors to each other at predetermined locations. The flex cable comprises cutouts to control circuit paths.

In accordance with one method of the present invention, a method of assembling a lighting assembly is provided comprising steps of providing a flex cable; and connecting a plurality of light emitted diodes (LEDs) directly to the flex cable. The step of connecting comprising teeth on leads of the LEDs piercing through conductors of the flex cable and being deformed to mechanically and electrically connect the leads to the conductors.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
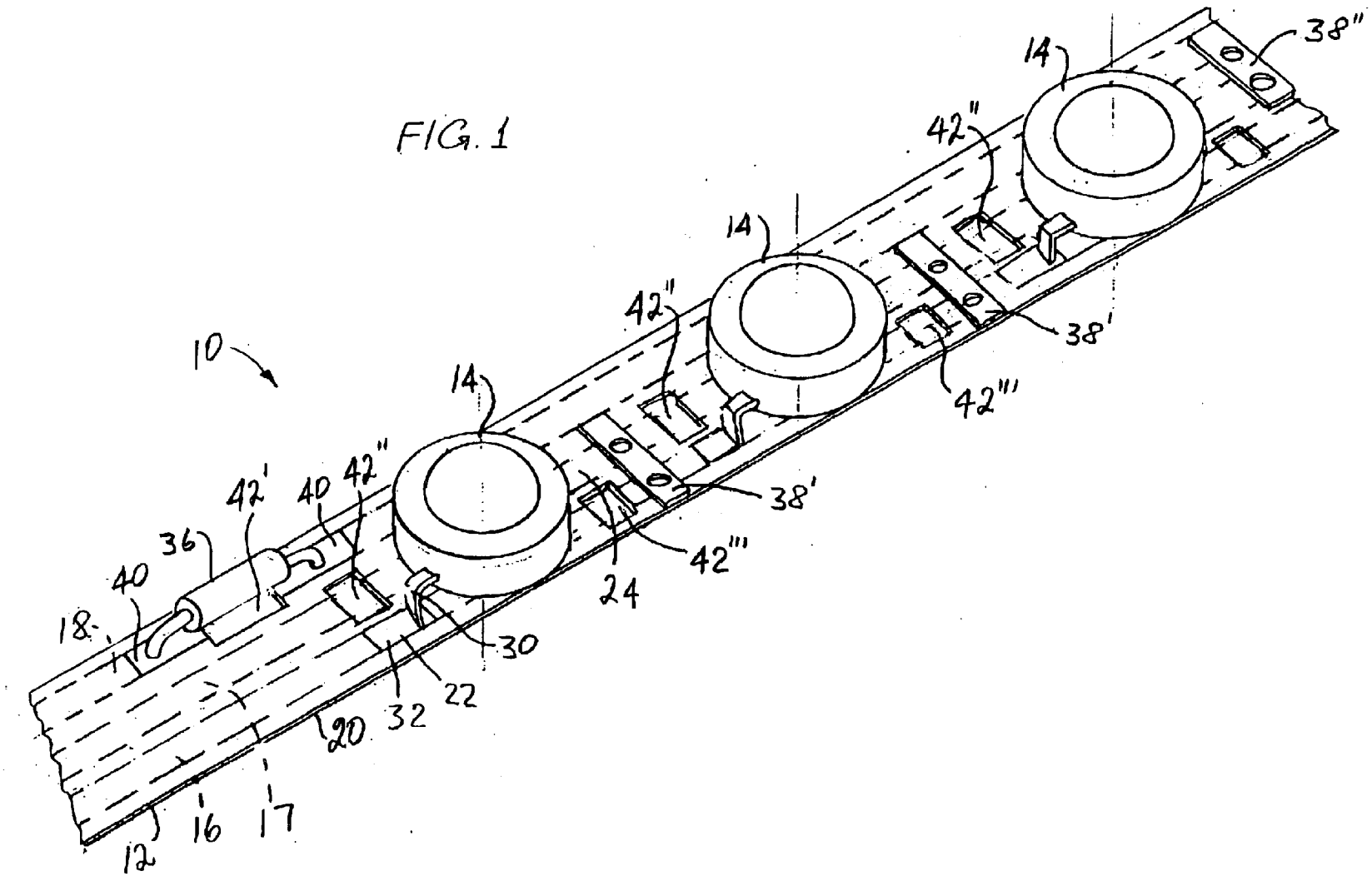
FIG. 1 is a perspective view of a lighting assembly incorporating features of the present invention.

Referring to FIG. 1, there is shown a perspective view of a lighting assembly 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

Figure 2:
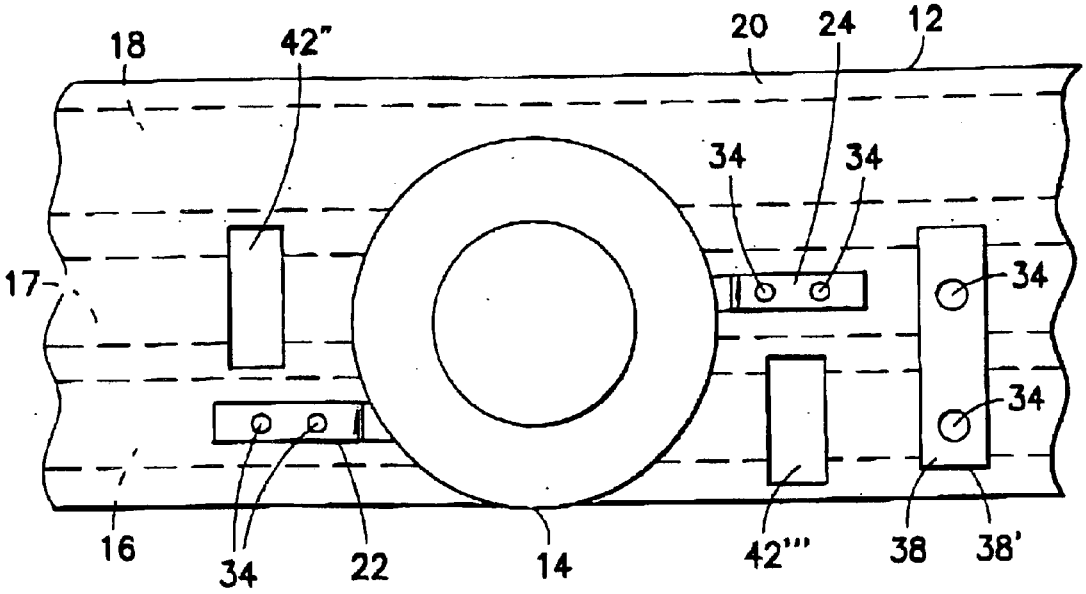
FIG. 2 is a partial top plan view of a portion of the lighting assembly shown in FIG. 1.

The lighting assembly 10 generally comprises a flex cable 12 and a plurality of lighting devices 14. As used herein, the term "flex cable" is intended to mean a flexible flat conductor cable (FFC) or a flexible printed circuit cable (FPC). Referring also to FIG. 2, the flex cable, in the embodiment shown, comprises a flexible flat conductor cable having three electrical conductors 16, 17, 18. The conductors 16, 17, 18 are flat conductors aligned parallel to each other. The flex cable 12 includes electrical insulation 20 which encapsulates and separates the electrical conductors from each other. In a preferred embodiment, the conductors are about 0.076 mm thick and are aligned with a centerline spacing of about 2.54 mm. However, any suitable type of flex cable could be provided.

The lighting devices 14, in the embodiment shown, generally comprises modified leaded surface mounted device (SMD) light emitting diodes (LEDs). The LEDs 14 could comprise a one or five Watt LED, for example. The assembly 10 is shown with three of the lighting devices 14. Each lighting device 14 comprises two leads 22, 24. The first lead 22 is attached to the first conductor 16. The second lead 24 is attached to the second conductor 17. Thus, the lighting devices 14 are directly connected to conductors of the flex cable.

Figure 3:
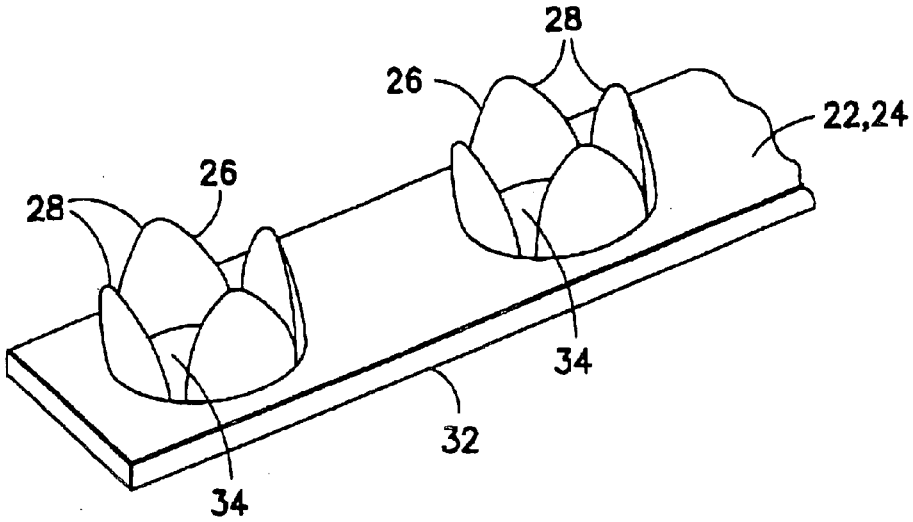
FIG. 3 is a bottom perspective view of the outward extending section of one of the leads of one of the lighting devices shown in FIG. 1.

Referring also to FIG. 3, a perspective view of the bottom of the outward extending section 32 of one of the leads is shown before attachment to the flex cable 12. The leads 22, 24 each comprise a downward extending section 30. (see FIG. 1), the outward extending section 32, and sets 26 of teeth 28 located on the outward extending section 32. Each set 26 of the teeth 28 are arranged around a hole 34 through the outward extending section 32. The teeth 28 are formed by stamping the outward extending sections 32 of the leads 22, 24. Each set 26 comprises four of the teeth 28. In a preferred method of forming the teeth 28, the teeth are formed as described in U.S. patent application Ser. No. 4,749,368, which is hereby incorporated by reference in its entirety. However, in alternate embodiments, any suitable method for forming the teeth 28 could be provided. The teeth 28 extend in a general downward direction from the outward extending section 32. The leads 22, 24 each comprise two sets 26 of the teeth 28. However, in alternate embodiments, more or less than two sets 26 could be provided.

The two leads 22, 24 are preferably offset from each other at a centerline spacing of about 2.54 mm to match the centerline spacing between the first and second conductors 16, 17. Thus, the first lead 22 can be attached to the first conductor 16 and the second lead 24 can be attached to the second conductor 17.

Figure 4:
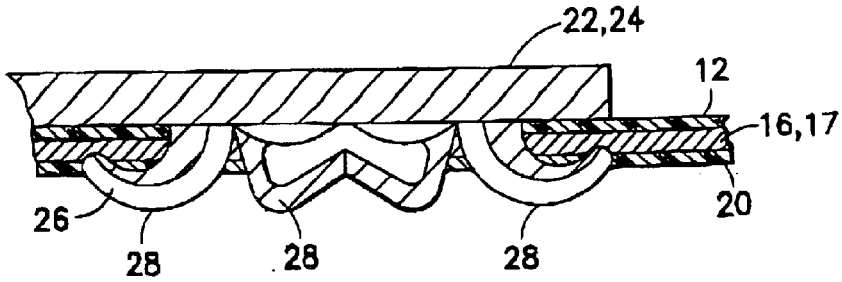
FIG. 4 is a cross sectional view showing a connection of one of the leads to the flex cable.

Referring also to FIG. 4, one of the sets 26 of the teeth 28 is shown attached to the flex cable 12. The leads 22, 24 are placed against an exterior side of the flex cable. The teeth 28 are pierced through the insulation 20 and one of the conductors 16 or 17 and deformed outward and upward as shown. Thus, ends of the teeth 28 are located on an opposite side of the flex cable from the main portion of the outward extending section 32. This forms an electrical connection with the conductors 16 and 17. This also forms a mechanical connection of the leads 22, 24 with the flex cable 12. Additional attachment means, such as adhesive, could also be used to attach the main body of the lighting device 14 to the exterior of the flex cable 12.

Referring back to FIGS. 1 and 2, the lighting assembly 10 also comprises a resistor 36 and splice terminals 38. The resister 36 is electrically and mechanically attached to the third conductor 18 by component to flex cable component terminals 40 similar to that described in U.S. Pat. No. 4,749,368.

The splice terminals 38 each comprise two sets 26 of the teeth 28. The two sets 26 are spaced from each other at a centerline spacing of about 2.54 mm. The splice terminals 38 are attached to the flex cable 12 to electrically attach two of the conductors 16, 17 or 17, 18 to each other at predetermined locations. More specifically, the first splice terminals 38' connect the first and second conductors 16, 17 to each other between each of the lighting devices 14. A second splice terminal 38" connects the second conductor 17 to the third conductor 18 at the end of the flex cable.

During assembly of the lighting assembly 10, cutouts 42 are formed in the flex cable 12 at predetermined locations. The cuts 42 completely sever individual ones of the conductors 16, 17, 18 at the predetermined locations. More specifically, a cutout 42' is formed in the third conductor 18 between the two flex cable component terminals 40, cutouts 42" are formed in the second conductor 17 before each lighting device 14, and cutouts 42'" are formed in the first conductor 16 after at least all of the lighting devices 14 except the last one on the end of the flex cable 12. The first splice terminals 38' connect the first and second conductors 16, 17 to each other between the two cutouts 42" located between each lighting device 14.

Figure 5:
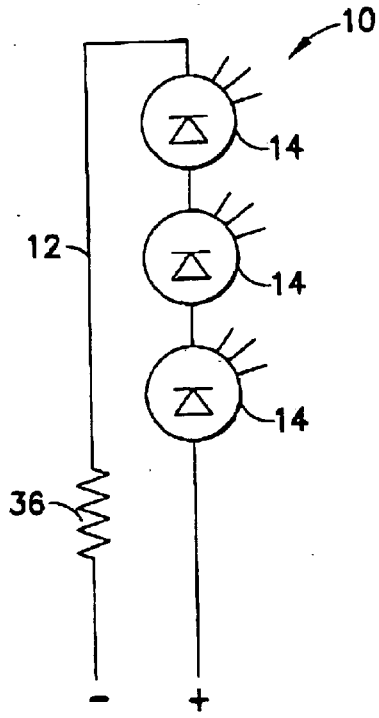
FIG. 5 is a schematic electrical diagram of the lighting assembly shown in FIG. 1.

The combination of the conductors 16, 17, 18, the cutouts 42 severing the conductors, and the splice terminals 38 combine to form a circuit path on the flex cable 12. The circuit path is completed by connection of the resistor 36 and lighting devices 14. Referring also to FIG. 5, a general circuit diagram of the lighting assembly 10 shown.

Figure 6:
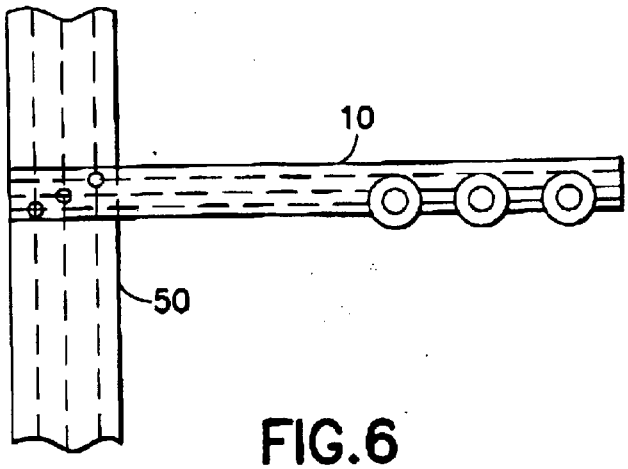
FIG. 6 is a top plan view of the lighting assembly shown in FIG. 1 shown attached to another flexible cable.

The invention as described above is primarily intended for automotive applications, but could be used anywhere LED lighting and flex circuitry is a consideration. The lighting assembly 10 can be used as accent lighting in an automobile. The invention creates a LED light assembly directly onto a section of a flex cable. Cutouts are plunged into the flex cable and the splice terminals 38 are crimped, to create a specific circuit path for the electricity. Leaded LEDs, modified to have the teeth geometry stamped into the leads, are crimped to the flex cable in the same fashion as the splice terminals. A resistor, to control the brightness of the LEDs, is attached by the flex cable component terminals. The flex cable circuits continue on to the power source and/or become a part of a larger part assembly. For example, referring also to FIG. 6, the lighting assembly 10 is shown connected to a larger flex cable 50 which is connected to a power source (not shown).

The present invention provides numerous advantages. The present invention increases reliability by eliminating the connector interface between the lighting devices 14 and the flex cable. The present invention lowers the cost of the assembly by eliminating the connector interface. The present invention provides a minimal package size which may be particularly advantageous in a limited space environment, such as an automobile. The present invention lowers the cost of the lighting assembly by minimizing preparation of the flex cable. The present invention also comprises fewer components than otherwise would be required. The lighting assembly can also be pre-assembled before it is inserted into an automobile receiving frame and attached to another flex cable. This can also reduce the weight of the lighting assembly, which is also particularly desirous in an automobile.

In alternate embodiments, the flex cable could comprise more or less than three electrical conductors. In alternate embodiments, other types of lighting devices, other than an LED, could be provided. In alternate embodiments, the assembly could comprise more or less than three lighting devices. Each set of teeth could comprise more or less than four teeth and could have any suitable type of shape. In an alternate embodiment, the two leads 22, 24 could be aligned with each other, such as when one of the cutouts is located directly below the lighting device 14; extending through one of the conductors which both of the leads 22, 24 are connected to.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A lighting assembly comprising:

a flex cable; and a plurality of lighting devices directly connected to conductors of the flex cable, wherein the lighting devices each comprise leads placed against an exterior side of the flex cable and have teeth which pierce through insulation of the flex cable and the conductors to make a mechanical and electrical connection with the flex cable, wherein the flex cable comprises cutouts to control circuit paths.

2. A lighting assembly as in claim 1 wherein the lighting devices comprise light emitted diodes (LEDs).

3. A lighting assembly as in claim 2 wherein the flex cable comprises a flat flexible cable having three of the conductors, and wherein the LEDs are directly connected to only two of the conductors.

4. A lighting assembly as in claim 1 wherein the teeth are arranged in at least one set on each lead, the set comprising a plurality of the teeth with a hole between the teeth in the set.

5. A lighting assembly as in claim 1 wherein the teeth comprise stamped and formed portions of the leads.

6. A lighting assembly as in claim 1 wherein, for each lighting device, a first one of the leads is connected to a first one of the conductors and a second one of the leads is connected to a second one of the conductors.

7. A lighting assembly as in claim 1 wherein the flex cable comprises cutouts through at least two of the conductors to control circuit paths.

8. A lighting assembly as in claim 7 further comprising splice terminals connecting two of the conductors to each other at predetermined locations.

9. A lighting assembly as in claim 8 further comprising at least one resistor connected to a third one conductors of the flex cable bridging a cutout in the third conductor.

10. A lighting assembly comprising:

a flex cable;

a plurality of light emitting diodes (LEDs) connected to conductors of the flex cable; and splice terminals connecting predetermined ones of the conductors to each other at predetermined locations, wherein the flex cable comprises cutouts to control circuit paths.

11. A lighting assembly as in claim 10 wherein the flex cable comprises a flat flexible cable having three of the conductors, and wherein the LEDs are directly connected to only two of the conductors.

12. A lighting assembly as in claim 10 wherein the teeth are arranged in at least one set on each lead, the set comprising a plurality of the teeth with a hole between the teeth in the set.

13. A lighting assembly as in claim 10 wherein the teeth comprise stamped and formed portions of the leads.

14. A lighting assembly as in claim 10 wherein, for each LED, a first one of the leads is connected to a first one of the conductors and a second one of the leads is connected to a second one of the conductors.

15. A lighting assembly as in claim 10 wherein the flex cable comprises cutouts through at least two of the conductors to control circuit paths.

16. A lighting assembly as in claim 15 further comprising at least one resistor connected to a third one conductors of the flex cable bridging a cutout in the third conductor.

17. A method of assembling a lighting assembly comprising steps of:

providing a flex cable; and connecting a plurality of light emitted diodes (LEDs) directly to the flex cable, the step of connecting comprising teeth on leads of the LEDs piercing through conductors of the flex cable and being deformed to mechanically and electrically connect the leads to the conductors, wherein the method further comprises forming cutouts through the conductors of the flex cable.

18. A method as in claim 17 further comprising attaching splice terminals at predetermined locations to connect the conductors to one another.

19. A method as in claim 17 further comprising attaching a resistor to one of the conductors at a cutout through the conductor.

20. A method as in claim 17 wherein the step of connecting the LEDs directly to the flex cable comprises positioning the leads on an exterior side of the flex cable against electrical insulation of the flex cable.

* * * * *